US010116041B2

(12) United States Patent
Alpaslan

(10) Patent No.: US 10,116,041 B2
(45) Date of Patent: Oct. 30, 2018

(54) TUNEABLE ANTENNA FOR A WIRELESS COMMUNICATION DEVICE

(71) Applicant: VODAFONE GMBH, Duesseldorf (DE)

(72) Inventor: Abbas Alpaslan, Witten (DE)

(73) Assignee: VODAFONE GMBH, Duesseldorf (DE)

( * ) Notice: Subject to any disclaimer, the term of this patent is extended or adjusted under 35 U.S.C. 154(b) by 31 days.

(21) Appl. No.: 15/246,785

(22) Filed: Aug. 25, 2016

(65) Prior Publication Data

US 2017/0062909 A1 Mar. 2, 2017

(30) Foreign Application Priority Data

Aug. 31, 2015 (EP) ..... 15183085

(51) Int. Cl.

| | |
|---|---|
| ***H01Q 1/38*** | (2006.01) |
| ***H01Q 1/24*** | (2006.01) |
| ***H01Q 3/12*** | (2006.01) |
| ***H01Q 3/44*** | (2006.01) |
| ***H01Q 9/04*** | (2006.01) |
| ***H01Q 21/00*** | (2006.01) |
| ***H01Q 5/335*** | (2015.01) |
| ***H01Q 5/378*** | (2015.01) |

(52) U.S. Cl.

CPC ..... *H01Q 1/243* (2013.01); *H01Q 3/12* (2013.01); *H01Q 3/44* (2013.01); *H01Q 5/335* (2015.01); *H01Q 5/378* (2015.01); *H01Q 9/0442* (2013.01); *H01Q 21/00* (2013.01); *H01Q 1/38* (2013.01); *H01Q 9/045* (2013.01)

(58) Field of Classification Search

CPC ..... H01Q 1/243; H01Q 5/335; H01Q 5/378; H01Q 3/12; H01Q 21/00

USPC ..... 343/702

See application file for complete search history.

(56) References Cited

U.S. PATENT DOCUMENTS

| | | | | |
|---|---|---|---|---|
| 6,753,819 | B1 | 6/2004 | Deinert et al. | |
| 2008/0001829 | A1* | 1/2008 | Rahola | H01Q 1/243 343/702 |
| 2011/0269418 | A1* | 11/2011 | Kangas | H04B 17/309 455/226.2 |
| 2013/0225088 | A1 | 8/2013 | Anderson | |
| 2015/0171501 | A1* | 6/2015 | Cruickshank | H01Q 1/50 343/745 |

OTHER PUBLICATIONS

Andreou et al., "Reconfigurable Planar Directional Antennas Printed on Ferrimagnetic Substrates", The 8th European Conference on Antennas and Propagation (EuCap 2014), Greece, pp. 1-5.

(Continued)

*Primary Examiner* — Andrea Lindgren Baltzell

(74) *Attorney, Agent, or Firm* — Grossman, Tucker, Perreault & Pfleger, PLLC

(57) ABSTRACT

The present invention relates to a tuneable antenna for a wireless communication device comprising at least one antenna element and at least one adaption element. The adaption element has an electric and/or magnetic susceptible material and is moveable relative to the antenna element. The position of the adaption element relative to the antenna element is adjustable by at least one actuator as a function of at least one of the antenna characteristics.

20 Claims, 7 Drawing Sheets

(56) References Cited

OTHER PUBLICATIONS

Zervos et al., "Mutual Coupling Control in a Multiple Antenna System Using Ferrimagnetic Substrate", The 8th European Conference on Antennas and Propagation (EuCap 2014), Greece, pp. 387-391.

* cited by examiner

TUNEABLE ANTENNA FOR A WIRELESS COMMUNICATION DEVICE

CROSS REFERENCE TO RELATED APPLICATIONS

This application claims priority to EPO Patent Application No. 5 183 085.8 filed on Aug. 31, 2015, the disclosure of which is incorporated by reference herein in its entirety.

FIELD OF THE INVENTION

The present invention relates to a tuneable antenna for a wireless communication device.

BACKGROUND

Today wireless communication devices, especially mobile communication devices are used in different telecommunications networks operated by different network operators. Those telecommunications networks are normally operated in different technology standards like GSM (GSM: Global System for Mobile Communications, also referred to as 2G), UMTS (UMTS: Universal Mobile Telecommunications standard, also referred to as 3G) and/or LTE (LTE: Long Term Evolution, also referred to as 4G). Beyond these networks the devices normally are also operated in WLANs (WLAN: Wireless Local Area Network) or communicate via Bluetooth. Further such antennas are used for GPS-devices (GPS: Global Positioning System) and/or GNSS-devices (GNSS: Global Navigation Satellite System). Furthermore these networks are normally operated in numerous different frequency bands or frequencies, which in addition can differ for certain geographical regions, for example in Europe or the United States. Therefore it is necessary to equip wireless communication devices, especially mobile communication devices with appropriate antennas or antenna systems.

A wireless communication device, especially a mobile communication device like a mobile phone, usually comprises an antenna or antenna system capable for sending and/or receiving electromagnetic signals within a specific frequency range or bandwidth. The frequency bandwidth is dependent on the physical characteristics of the antenna itself, for example length, height, form or size. For operating in different frequency bands of telecommunications networks an antenna itself normally has to be big to cover up different frequency bandwidths. Consequently, such an antenna is physically too big for a normally sized mobile device of today. A user with a device fitted for an antenna performance in certain frequency bands for one region, like for example the United States, will experience a decline in antenna performance when travelling in Europe because the telecommunications networks are operated in different frequency bands.

Furthermore the antenna performance and/or the antenna characteristics are adversely affected and/or influenced by surrounding or environmental factors such as objects, like a wall or a table, or by the user of a mobile device himself, for example with his head and/or hand, for example in a so called talk mode or browsing mode.

Normally manufacturers of antennas and/or mobile devices try to overcome the challenges of different frequency scenarios in telecommunications networks by using different antenna set ups and/or types within the mobile devices for different regions. This is causing additional costs for the productions, logistics and also approval procedures.

SUMMARY

Therefore it is an object of the present invention to avoid the drawbacks in the prior art and to provide a tuneable antenna for a wireless communication device, especially a mobile communication device, which improves the performance of a wireless communications device and reduces the amount of model variety, especially concerning hardware.

The object is achieved by a tuneable antenna for a wireless communication device, comprising at least one antenna element and at least one adaption element, wherein said adaption element has an electric and/or magnetic susceptible material and is moveable relative to said antenna element, and wherein the position of said adaption element relative to said antenna element is adjustable by at least one actuator as a function of at least one of the antenna characteristics.

The invention is based on the knowledge that a change of a position of an adaption element having an electric and/or magnetic susceptible material relative to an antenna or antenna element can positively effect the antenna performance of a wireless communication device especially concerning external, environmental and/or surrounding conditions, which preferably can be used as a trigger for such a change of a position. This is according to the present invention preferred established with the at least one actuator, especially without a need to open the wireless communication device.

According to the present invention the relative position of the adaption element relative to the antenna or antenna element influences at least one of the antenna characteristics of the antenna. The antenna is specified by a number of various antenna characteristics. Such antenna characteristics according to the present invention can relate to the antenna's directional characteristics, which are specified for example by the antenna's power gain. The antenna's power gain or simply gain relates to the antenna's efficiency and is in the present case a primary figure of the antenna performance Antennas are also used around a particular resonant frequency as one of the antenna characteristics. The antenna of the present invention is preferably designed to match the frequency range of the intended usage, also called resonant antenna. A further antenna characteristic according to the present invention is the feedpoint impedance and/or the complex impedance. These impedances can advantageously be tuned to a desired impedance level of the antenna, especially by using a matching network. The complex impedance of an antenna is furthermore related to the electrical length of the antenna at the wavelength in use. According to an embodiment of the present invention the influenced antenna characteristics of the antenna are the radiation pattern, the antenna gain, the electrical field strength and/or band width. This also effects the effective electrical length of an antenna or antenna element in such a way that for example the antennas or antenna element's resonance frequency is shifted. The frequency shifting is preferably used to re-establish optimal antenna characteristics or to re-establish an optimal antenna performance to overcome disadvantageous surrounding conditions, which advantageously are determined by means for determining the at least one of the antenna characteristics.

Susceptibility in the sense of the present invention is a response or reaction of a material to an applied field, especially an electric field and/or a magnetic field for an electric susceptibility and/or a magnetic susceptibility.

An electric susceptibility $\chi_e$, is defined as the constant of proportionality relating an electrical field E to an induced dielectric polarization density P such as:

$$P=\varepsilon_0\chi_e E$$

where P is the polarization density, $\varepsilon_0$ is the electric permittivity of free space, $\chi_e$, is the electric susceptibility and E the electrical field. The electric susceptibility $\chi_e$, of a material is related to its relative permittivity, $\varepsilon_r$ by $$\chi_e=\varepsilon_r-1$$

In this way the electric suspectibility $\chi_e$, influences the electric permittivity or dielectric characteristic or capacity of the material.

A magnetic susceptibility $\chi_m$ is defined as the constant of proportionality relating a magnetic field H to the magnetisation M of a material such as:

$$M=\chi_m H$$

The magnetic susceptibility $\chi_m$ of a material is related to its relative permeability $\mu_r$ by $$X_m=\mu_r-1$$

Adjusting the position of the adaption element with the actuator according to the present invention advantageously results in improvements regarding the quality and/or conditions for transmitting and/or receiving. As a further advantage the user experience is better due to achievable improvements regarding quality of service (QoS), voice quality, data throughput, accessibility and/or reachability.

Furthermore the tuneable antenna of the present positively effects the battery life of a wireless communication device and/or the level of the so called SAR (SAR: Specific Absorption Rate) of a wireless communication device, especially since the antenna performance is more efficient. The efficient antenna performance also enables energy saving on the network infrastructure side for example in reducing the transmitting power of a base station or NodeB.

According to an advantageous embodiment of the present invention said antenna characteristic is the radiation pattern of the antenna. This especially allows controlling the antenna performance dependent on the radiation pattern of the antenna, also called antenna pattern, as one of several key antenna characteristics, especially for so called "Beam Forming". The radiation pattern advantageously defines the variation of the power radiated by the antenna as a function of the direction away from the antenna. The "Beam Forming" is especially a key role for the so called 5G-technology in Next Generation Mobile Networks. With that the present invention advantageously makes use of the knowledge that the radiation pattern can be affected by obstacles in the surroundings of the antenna and therefore does not work in a certain direction of the radiation pattern at its optimal performance level. The inventive usage of the radiation pattern as indicating antenna characteristic advantageously in relation to a certain frequency or frequency band allows an efficient configuration of the antenna or antenna element especially with regard to the antenna performance.

In another advantageous embodiment of the present invention said antenna characteristic is at least one resonant frequency of the antenna. With that the present invention advantageously makes use of the knowledge that an antenna is a circuit of inductances and capacitances with at least one resonant frequency, whereby the antenna operated with the resonant frequency appears purely resistive. The inventive usage of at least one resonant frequency as antenna characteristics advantageously allows an efficient configuration and operation of the antenna or antenna element with regards to the antenna performance.

In another advantageous embodiment of the present invention the function of said antenna characteristic is dependent on the conditions of transmitted and/or received antenna power of the antenna. This allows adapting the antenna in an efficient way preferably in consideration of the actual operation power of the antenna respectively the actual operational power configuration of the antenna. The ratio of received and transmitted radio power as one of the antenna characteristics is advantageously used for adjusting the position of said adaption element relative to the antenna. With that advantageously the reciprocity theorem of electromagnetic, which says that a receiving pattern of an antenna when used for receiving is identical to the far-field radiation pattern of the antenna when used for transmitting, is applied.

In another advantageous embodiment of the present invention said antenna characteristics are electrically and/or magnetically influenceable from the extent of overlapping of the body of said adaption element and the body of said antenna element. Moving said adaption element relative to said antenna element causes advantageously an overlapping of the bodies to a more or less degree, extent respectively level. The overlapping area respectively the non-overlapping area of the two bodies influences the capacitance and with that the electrical field strength. This effects the frequency of the antenna, especially the operating frequency and/or the resonant frequency of the antenna.

In another advantageous embodiment of the present invention the antenna further comprises a magnet, wherein said magnet and said adaption element are moveable relative to each other. Moving said magnet and said adaption element relative to each other effects advantageously the degree of magnetisation of said adaption element and/or material of said adaption element in response to the magnetic field of the magnet.

In another advantageous embodiment of the present invention said adaption element and/or the electric susceptible material of said adaption element is shaped to adjust said antenna characteristics. The design of the shape of said adaption element or of the electric susceptible material of said adaption element effects advantageously the capacitance and thus the electrical field respectively the inhomogeneity of the antenna. When said adaption element or the electric susceptive material of said adaption element is moved relative to the antenna or said antenna element the shape causes the field lines of the electrical field to become more or less inhomogeneous. This relation is advantageously a factor of inhomogeneity of the antenna characteristics. In a preferred embodiment of the present invention the shape of said adaption element or of the electric susceptible material of said adaption element is designed to change and/or adapt the factor of inhomogeneity as one of the antenna characteristics. In a further embodiment of the present invention said adaption element or the electric susceptible material of said adaption element is shaped non-rotationally symmetric to influence the antenna characteristics, especially the capacitance of the antenna. In a preferred embodiment the shape of the adaption element or the electric susceptible material of said adaption element is a semicircle, a sector and/or of a rectangular form.

A further advantageous embodiment of the present invention suggests to change the dielectric constant of the electric susceptible material, preferably of a dielectric material of said adaption element effecting the capacitance of the antenna respectively antenna element, especially to change and/or adapt the factor of inhomogeneity as one of the antenna characteristics.

In another embodiment of the present invention the electric susceptible material, preferably the dielectric material of said adaption element has a high-dielectric constant material with a minimal loss, preferably said dielectric material is one of Aluminium oxide, Titanium oxide, Strontium Titanate and/or low-loss ferrites or a combination thereof. The usage of such a material allows a higher tuning effect regarding the capacitance and thus the antenna characteristics, especially for tuning of the frequency of the antenna. This is mainly based on the effect of such an electric susceptible material with a very high relative permittivity or dielectric constant moved in or into the electrical field of the antenna.

In a further advantageous embodiment of the present invention the magnetic susceptible material of said adaption element has a high-magnetic constant with a minimal loss, preferably, said magnetic susceptible material is a low-loss ferrite. The usage of such a material allows a higher tuning effect regarding the inductance and thus the antenna characteristics, especially for tuning the frequency of the antenna. This is mainly based on the effect of such a magnetic susceptible material with a high relative permeability or magnetic constant moved in or into the magnetic field of the antenna.

In another advantageous embodiment of the present invention said adaption element and/or the magnetic susceptible material of said adaption element is magnetically influencable from the extent of overlapping of the body of said magnet. Moving said adaption element and said magnet relative to each other causes advantageously an overlapping of the bodies of the adaption element and/or the magnetic susceptible material and/or the magnet to a more or less degree, extent respectively level. The overlapping area respectively the non-overlapping area of the two bodies influences the degree of magnetisation of the magnetic susceptible material and with that the permeability. This effects the frequency of the antenna, especially the operating frequency and/or the resonant frequency of the antenna.

In a further embodiment of the present invention said adaption element is rotatable and/or pivotable relative to said antenna element.

In another embodiment of the present invention said adaption element is mounted on said actuator.

These embodiments of adaption element and actuator-alone and/or in combination with each other—allow an arrangement of the same in various locations respectively positions relative to the antenna or said antenna element, preferably dependently on the intended adjusting. The degree of freedom of the location respectively position of adaption element and actuator allow advantageously a selective adjusting of said antenna characteristics preferably to achieve a higher tuning effect. Advantageously the arrangement also allows a direct and fast adjusting of the position of the adaption element without additional mechanical and/or electrical connections to adjust or move the adaption element.

In another embodiment of the present invention the antenna further comprises control means for controlling said actuator for adjusting the position of said adaption element relative to said antenna element and/or for controlling means for determining the at least one of the antenna characteristics. The control means advantageously allow a selectively adapting of the antenna performance in a dynamic way, preferably with respect to changing environmental conditions effecting on the antenna or said antenna characteristics, especially on the antenna in a mobile communication device.

The control means, preferably a chip set, can advantageously be configured as an open-loop controller or a closed-loop controller. An open-loop controller in the sense of the present invention is a type of control means that determines its input into a system, at hand of the antenna, using only the current state and its model of the system without using a feedback loop between output and input. To obtain a more accurate or more adaptive control it is advantageously proposed to use a closed-loop controller, which in the sense of the present invention feeds the output of the system, at hand of the antenna, back to the inputs of the controller.

In another embodiment of the present invention the antenna further comprises at least one tuneable matching circuit for adjusting the impedance of the antenna, preferably the impedance of said antenna element.

In another embodiment of the present invention said tuneable matching circuit interacts with the control means for adjusting the impedance of the antenna. In a preferred embodiment of the present invention the control means interacting with said tuneable matching circuit are further adapted for adjusting the position of said adaption element relative to said antenna element as a function of said antenna characteristics.

The tuneable matching circuit of the antenna is advantageously applied as a measure in combination with the adjusting of a position of the adaption element relative to the antenna element or as a stand-alone tuning means. The matching circuit preferably allows a frequency tuning of the resonance frequency as one of the antenna characteristics. The inventive combination of tuneable matching circuit and adjustable positioning of said adaption element allows in sum a larger and/or more efficient tuning effect of the antenna characteristics of the antenna or said antenna element. Advantageously, when applying these tuning and adjusting means in combination the antenna design or layout can be constructed much simpler, for example more flat, and/or the antenna or said antenna element does not require a large frequency bandwidth as one of the antenna characteristics. This further allows advantageously an independent tuning, which especially is important for a so called Carrier Aggregation LTE networks and/or for MIMO-systems (MIMO: Multiple Input Multiple Output).

In another embodiment of the present invention said actuator is an electric motor, preferably said actuator is a vibra motor. The usage of an electrical motor as actuator allows a simple and more precise and continuous adjusting of the position of said adaption element relative to said antenna element or the antenna advantageously dependent on changing environmental conditions effecting on the antenna or said antenna characteristics. The size of the electric motor is preferably small or designed in such a way to be fitted in a wireless communication device, especially a mobile communication device like a mobile phone. With a vibra motor advantageously saving of space is possible, especially in a mobile communication device. Additionally a vibra motor can be used for vibration alarms. Thus a vibra motor advantageously can be used for adjusting the position of said adaption element relative to said antenna element or the antenna and/or for vibration alarms, especially instead of an implementation of two vibra motors which would need space for two vibra motors.

In another advantageous embodiment of the present invention a first resonant frequency of the antenna is separately adjustable form a second resonant frequency of the antenna by at least one actuator. The usage of a separate or selective adjustment of different resonant frequencies of the antenna advantageously allows a frequency band selective adjusting or independent tuning of a resonant frequency of the antenna or antenna element. For example, this separate adjusting mechanism can be used in a so called MIMO antenna system. Advantageously this can also be used for carrier aggregation such as for LTE and therefore enabling the separate tuning of at least two or more frequency bands such as LTE band 20 and LTE band 3 and/or LTE band 7.

Further details, characteristics and advantages of the present invention are explained in the following in more detail based on the description of the exemplary embodiments shown in the figures of the drawing.

DETAILED DESCRIPTION

Figure 1:
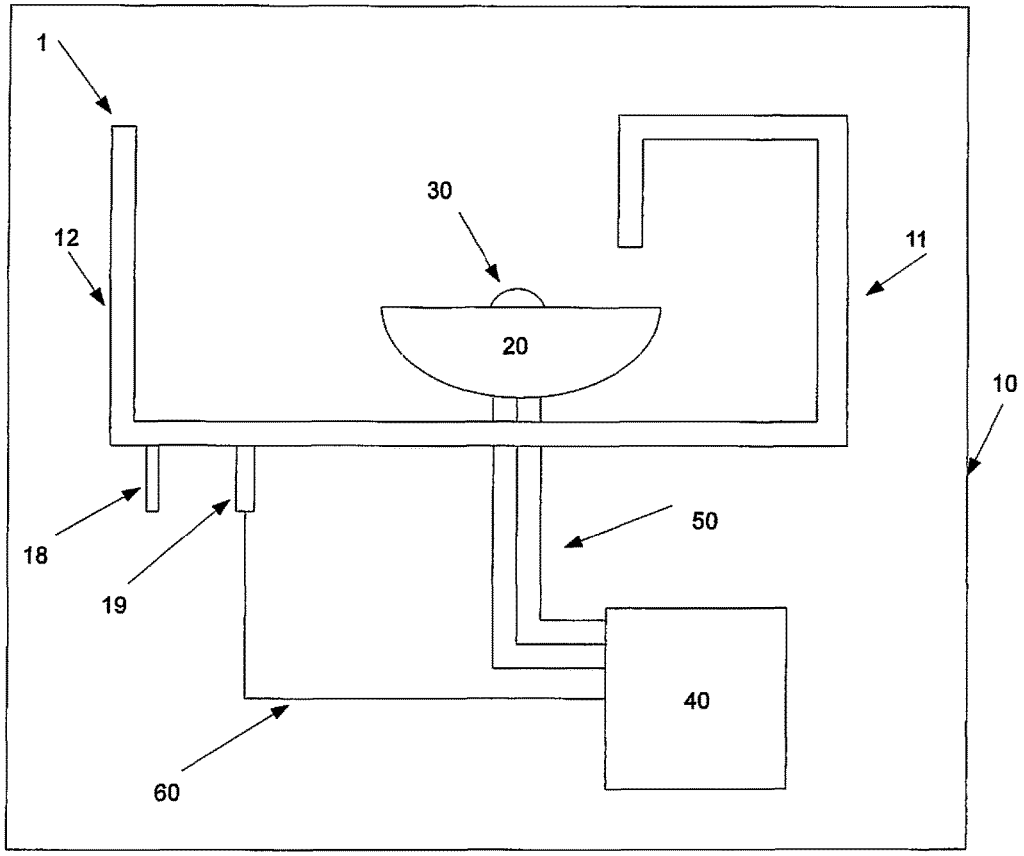
FIG. 1 shows a principal exemplary embodiment of an antenna according to the present invention.

FIG. 1 shows a principal exemplary embodiment of an antenna 1 according to the present invention. The antenna 1 as an electrical device converts electrical power into radio waves and vice versa.

The antenna 1 is arranged on a circuit board 10 and consists of an arrangement of metallic conductors as antenna elements 11 and 12, which are electrically connected from a feedpoint 19 via a connection 60 to other electrical components, in the present case especially control means 40 for controlling and/or tuning the antenna characteristic. With that the antenna 1 comprises an antenna volume associated with the antenna 1 for sending and/or receiving electromagnetic signals. The antenna 1 and/or the antenna elements 11 and 12 are suitable for transmitting and/or receiving electromagnetic signals in a certain frequency or frequency band, especially frequencies according to GSM, UMTS and/or LTE. The antenna 1 may also include additional elements or surfaces, such as parasitic elements (not shown in FIG. 1).

The antenna 1 further comprises an electric motor 30, especially a vibra, which is located or arranged close to the antenna 1, especially within the antenna volume. The vibra 30 is at hand used as an actuator on which an adaption element 20 is mounted. The adaption element 20 consists of or comprises an electric susceptible material, presently a dielectric material, which has a high-dielectric constant with a minimal loss. The dielectric material or dielectric of the adaption element 20 acts like an electrical insulator and effects the electric field of the antenna 1 when placed therein. The dielectric is a material with a high polarizability, which is expressed by a constant or number called the relative permittivity $\square_1$ also known as dielectric constant $\square_1$. The relative permittivity $\square_1$ is frequency-dependent. The dielectric material of the adaption element 20 at hand is preferably Aluminum oxide, Titanium oxide, and/or Strontium titanate or low-loss ferrites, such as YIG film (YIG: Yttrium Iron Garnet).

The electric motor respectively vibra 30 serving as actuator of the adaption element 20 is electrically connected to the control means 40 via connections 50 and is at hand horizontally arranged on the circuit board 10. The rotational axis of the electric motor 30 is orientated vertical to the area or surface of the circuit board 10. A rotation about the rotational axis of the electric motor 30 is designed to adjust the position of the adaption element 20 relative to the antenna elements 11 and 12. The area or the longitudinal axis of the adaption element 20 is also orientated vertical to the area of the circuit board 10. The adaption element 20 is clockwise and/or counter-clockwise rotatable around the rotational axis of the electric motor 30, especially in a range between a first angle and a second angle relative to the rotational axis of the actuator or in a range of an angularity relative to the rotational axis of the actuator. The range between the first and second angle or the range of angularity is preferably between 0° to 360° or between 0° to 180°. The adaption element 20 at hand is non-rotationally-symmetric arranged on the electric motor 30 with respect to the rotational axis of the electric motor 30.

In a further embodiment of the present invention (not shown) the adaption element 20 respectively dielectric material of the adaption element 20 is rotationally symmetric with respect to the rotational axis of the electric motor 30. In the latter case the dielectric material of the adaption element 20 has to have a non-rotationally symmetric shape with respect to the rotational axis of the electric motor 30. The adaption element 20 and/or the electric motor 30 can be arranged in such a way that the adaption element 20 respectively the dielectric material of the adaption element 20 is moved or rotated on a level with a distance to the antenna elements 11 and 12. This can be between the antenna elements 11 and 12 respectively the body of the antenna elements 11 and 12 below the circuit board 10 (compare for example FIG. 1, FIG. 2, FIG. 3) and/or above the circuit board 10 (compare for example FIG. 4).

The dielectric material of the adaption element 20 has a shape that is designed to adjust a factor of inhomogeneity of the antenna characteristics, for example as a function of the position of the dielectric material of the adaption element 20 relative to the antenna elements 11 and 12. The shape of the dielectric material of the adaption element 20 is preferably a semicircle, a sector and/or of a rectangular form. The factor of inhomogeneity is dependent on a position or angular of the dielectric material of the adaption element 20 relative to the rotational axis of the electric motor 30.

In a further embodiment of the present invention (not shown) it is proposed that the electric motor 30 and the dielectric material of the adaption element 20 are arranged separately from each other, for example especially on the circuit board 10, whereby the dielectric material of the adaption element 20 is movable—especially by the electric motor 30—relative to the antenna 1 or the antenna elements 11 and 12.

The electric motor 30 is—as mentioned above—designed to move or rotate the adaption element 20 respectively the dielectric material of the adaption element 20 relative to the antenna 1 respectively antenna elements 11 and 12. For this the electric motor 30 at hand has a direct-current source which enables the electric motor 30 to rotate or move the dielectric material of the adaption element 20 mounted thereon clockwise or counter-clockwise about the motor's rotational axis in a full revolution or alternatively in a range of angles respectively angular ranges, especially between an angle of 0° to 180°. The angle is advantageously monitored and/or controlled by the control means 40, which preferably control the electric motor 30 to adjust the position of the adaption element 20 respectively the dielectric material of the adaption 20 relative to the antenna elements 11 and 12.

The control means 40 advantageously comprise a chip set which has a tuning interface to tune the electric motor 30. The tuning is preferably done by controlling the steering voltage of the electric motor 30 and the angle position of the motor driven actuator or the dielectric material respectively adaption element 20. The characteristic curve of the combination of antenna 1, motor 30 and dielectric material of the adaption element 20 is captured or recorded as at least one of the antenna characteristics, especially to be able to adjust the position of the dielectric material of the adaption element 20 relative to the antenna elements 11 and 12. The values of this characteristic curve are preferably also stored within the chip set 40.

The chip set of the control means 40 further advantageously comprises software for controlling the process of adjusting the position of the dielectric material of the adaption element 20 relative to the antenna elements 11 and 12 as a function of the antenna characteristics. The software contains respectively comprises algorithms for optimizing the characteristic of the antenna 1 or the antenna performance. The control means 40 are preferably be operated as an open-loop controller or a closed-loop controller.

The control means 40 advantageously further interacts with sensor means or detector means (not shown) for determining or measuring at least one of the antenna characteristics. The sensor means can for example be integrated within the chipset of the control means 40 or arranged separately within the wireless communications device, for example on the circuit board 10. The type of sensor can be a passive or an active sensor. The sensor is adapted to determine or measure at least one of the antenna characteristics.

Figure 2:
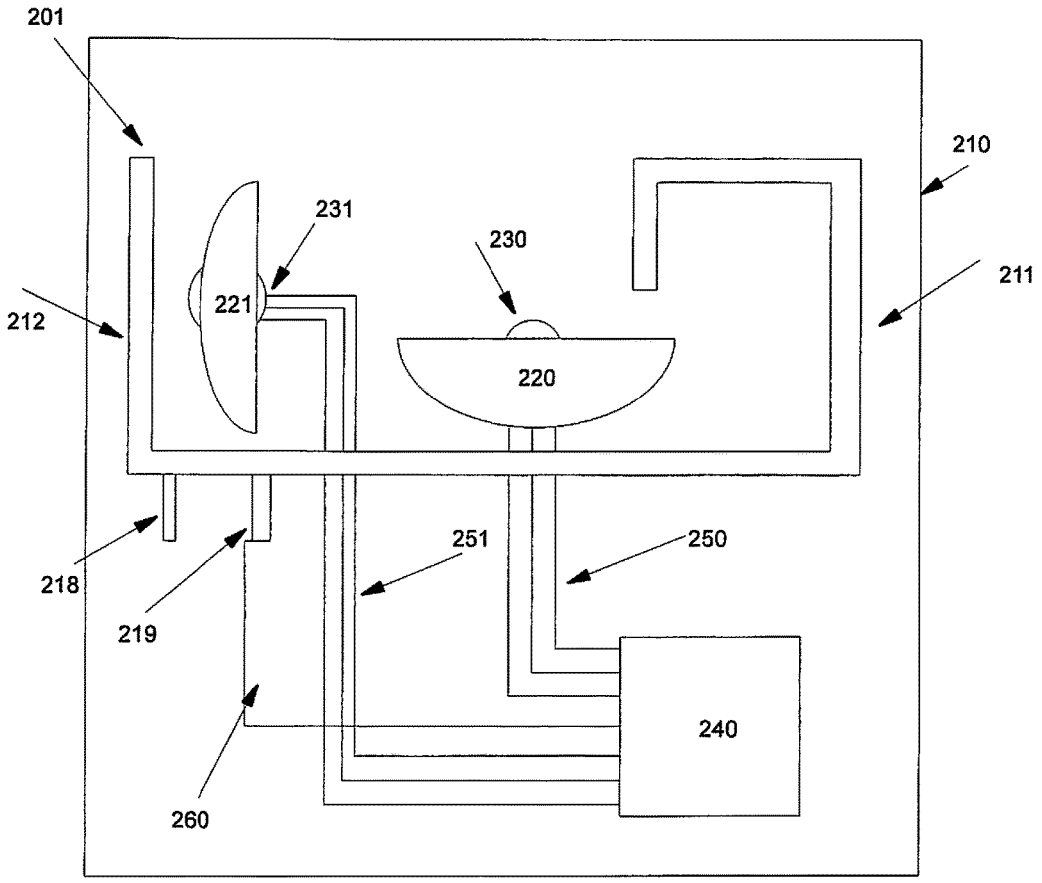
FIG. 2 shows a principal exemplary embodiment of a further antenna according to the present invention.

FIG. 2 shows a principal exemplary embodiment of a further antenna 201 according to the present invention. The functions of the elements and/or parts of the antenna 201 according to FIG. 2 are similar or correspondent to the one of the antenna 1 according to FIG. 1.

The antenna 201 comprises a first antenna element 211 and a second antenna element 212. The first antenna element 211 is designed to operate in a first frequency band, for example a high frequency band or a low frequency band. The second antenna element 212 is designed to operate in second frequency band, for example in a low frequency band or a high frequency band.

The antenna 201 comprises a first electric motor 230 with a first adaption element 220 respectively dielectric material 220 and a second motor 231 with a second adaption element 221 respectively second dielectric material 221. This configuration enables a selective frequency band optimization for the antenna 201. Each of the electric motors 230 and 231 is electrically connected via separate connections 250 and 251 with control means 240. The control means 240 preferably comprise a chip set for the antenna 201 which is designed to control the electric motors 230 and/or 231.

The position or location of the electric motors 230 and 231 is preferably arranged relative to each of the antenna elements 211 and 212 for a selective adaption of the frequency band of the antenna elements 211 and 212. This also advantageously allows a separate frequency band adaption or adjustment of the resonant frequency of each of the two frequency bands. This further advantageously allows a band selective adjusting of the antenna 201. Advantageously it is proposed that the resonance frequency of the Low Band, for example between 700 MHz to 900 MHz, can be adjusted without significantly and adversely affecting the resonance frequency of the High Band, for example between 1800 MHz to 2600 MHz.

In a further embodiment of the present invention (not shown) the antenna 201 comprises two adaption elements 220 and 221 which are driven by one electric motor. Thereby the electric motor is adapted to control or adjust the position of each of the two adaption elements 220 and 221 separate from each other relative to the antenna elements 211 and 212.

In a further embodiment of the present invention (not shown) the antenna 201 comprises two adaption elements 220 and 221. The antenna 201 further comprises a magnet 270 which is arranged close to the adaption element 221. The adaption element 221 has a magnetic susceptible material. The adaption element 220 has a dielectric material. This combination of adaption elements 220, 221 advantageously effects the antenna characteristics of the antenna 201, such as at least one of the resonant frequencies of the antenna element 211, 212.

Figure 3:
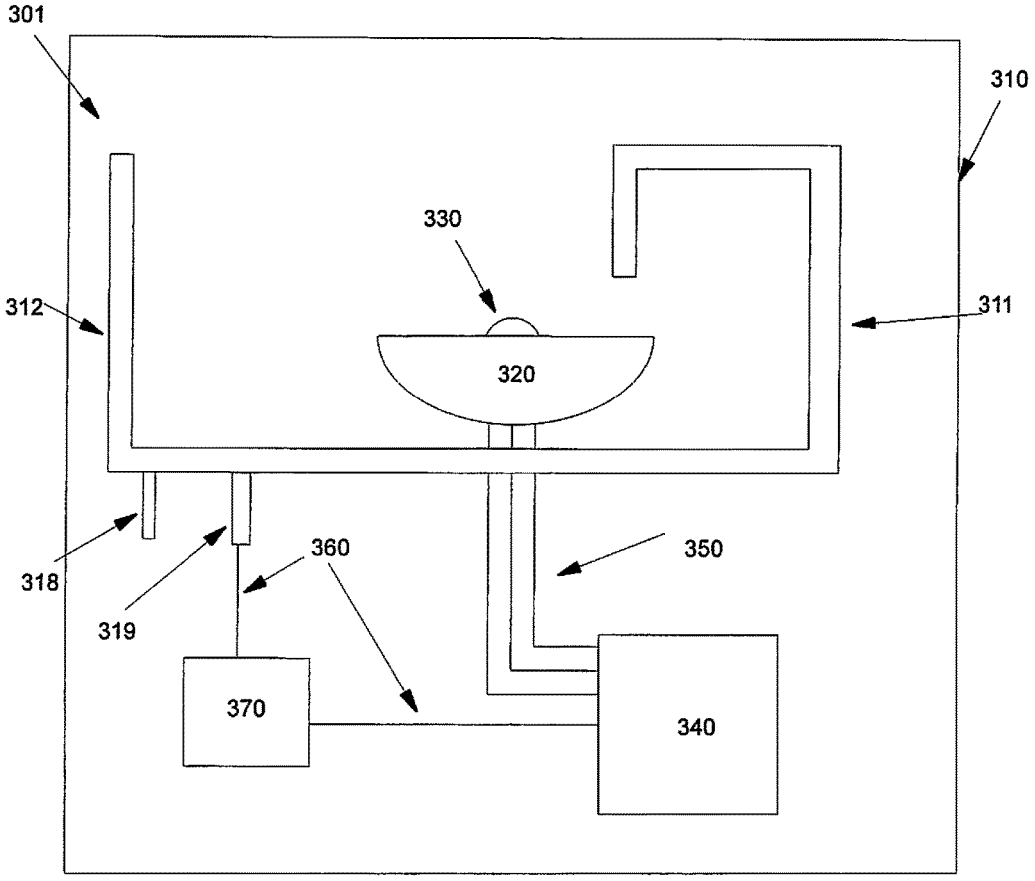
FIG. 3 shows a principal exemplary embodiment of a further antenna according to the present invention.

FIG. 3 shows a principal exemplary embodiment of a further antenna 301 according to the present invention. The functions of the elements and/or parts of the antenna 301 according to FIG. 3 are similar or correspondent to the one of the antenna 1 according to FIG. 1.

The antenna 301 according to FIG. 3 differs from the antenna according to FIG. 1 in that a tuneable matching circuit 370—also called TMC 370—is provided for the antenna 301. The TMC 370 is connected with the feedpoint 319 of the antenna 301 and with the control means 340 via connection 360.

The TMC 370 for the antenna 301 is advantageously for impedance matching of the antenna impedance. The TMC 370 is preferably designed for optimizing the antenna impedance of the antenna 301 by changing an applied voltage of the TMC 370 of the antenna 301. The antenna 301 or the antenna elements 311 and 312 itself, especially the effective electrical length of the antenna 301, are advantageously not affected by this measure of impedance matching.

The antenna 301 is advantageously operated with the movable adaption element 320 and the electric motor 330 in combination with the TMC 370. This advantageously results in a variety of useable measures for adjusting the characteristic of the antenna 301. In sum a higher tuning effect for the antenna 301 is achieved, especially for tuning the resonance frequency of the antenna elements 311 and 312. Furthermore advantageously a higher or bigger effect of shifting the resonance frequency, for example from one frequency band at for example about 700 MHz to another frequency band at for example about 800 MHz is achieved by the inventive combination of movable adaption element 320 and electric motor 330 in combination with the TMC 370. Advantageously the TMC 370 can be used for fine tuning the resonance frequency of the antenna 301, especially by tuning in a smaller range compared to the effect of an adjustable adaption element 320 adjusted by a motor 330 alone. Advantageously both measures can be used in combination in such a way that the TMC 370 effects the antenna 301 and the adaption element 320 with the motor 330 especially effects the capacitance and with that the effective electrical length of the antenna 301 and consequently the resonance frequency of the antenna 301.

Figure 4:
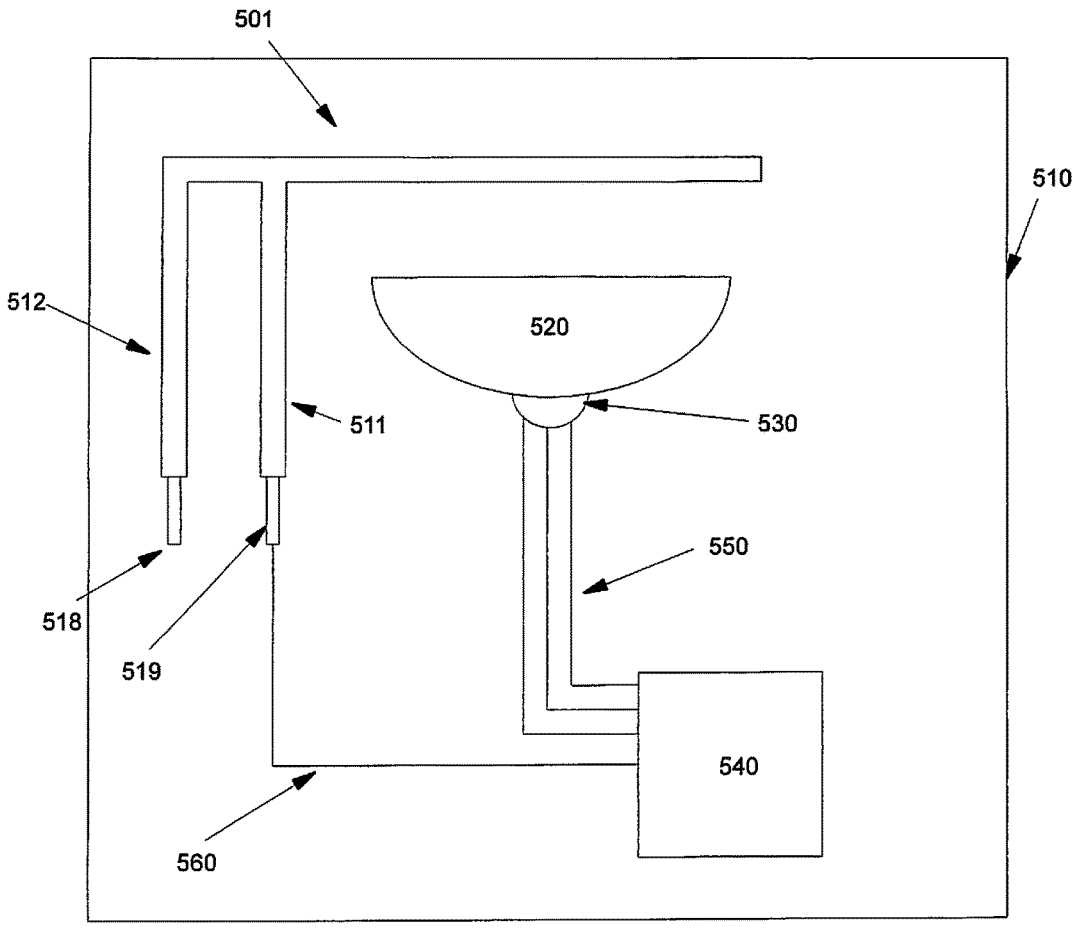
FIG. 4 shows a principal exemplary embodiment of a further antenna according to the present invention.

FIG. 4 shows a principal exemplary embodiment of a further antenna 401 according to the present invention. The functions of the elements and/or parts of the antenna 401 according to FIG. 4 are similar or correspondent to the one of the antenna 1 according to FIG. 1.

The antenna 401 according to FIG. 4 is a so called Inverted F-Antenna also referred to as IFA. The antenna 401 can be applied with lots of different antenna technologies, forms, types or concepts like for example a Planar Inverted Antenna also referred to as PIFA, an Inverted F-Antenna (IFA), a Planar Inverted L-antenna also referred to as PILA or an antenna printed on a circuit board—which also includes a slot antenna type, a film antenna with plastic carrier, an antenna containing stamped bent parts or a dipole antenna.

Figure 5A:
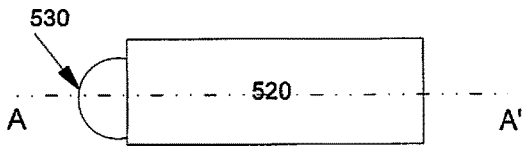
FIG. 5A shows in a detailed view a principal exemplary embodiment of an arrangement of an electric motor and an adaption element of an antenna according to the present invention.
Figure 5B:
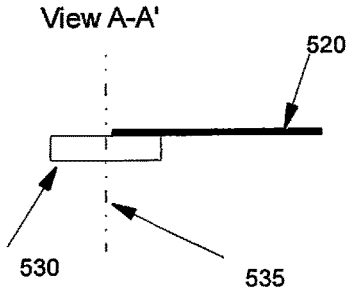
FIG. 5B shows a sectional view along axis AA' according to FIG. 5A.

FIG. 5A and FIG. 5B show in a detailed view a principal exemplary embodiment of an arrangement of an electric motor 530 and an adaption element 520 respectively the dielectric material of said adaption element 520 of an antenna according to the present invention. The dielectric material of the adaption element 520 is mounted non-symmetrically relative to a rotational axis 535 of the electric motor or vibra 530. This type of mounting effects advantageously a bigger change of the capacitance of the antenna when moving the dielectric material of the adaption element 520 relative to the antenna element of the antenna.

Figure 6:
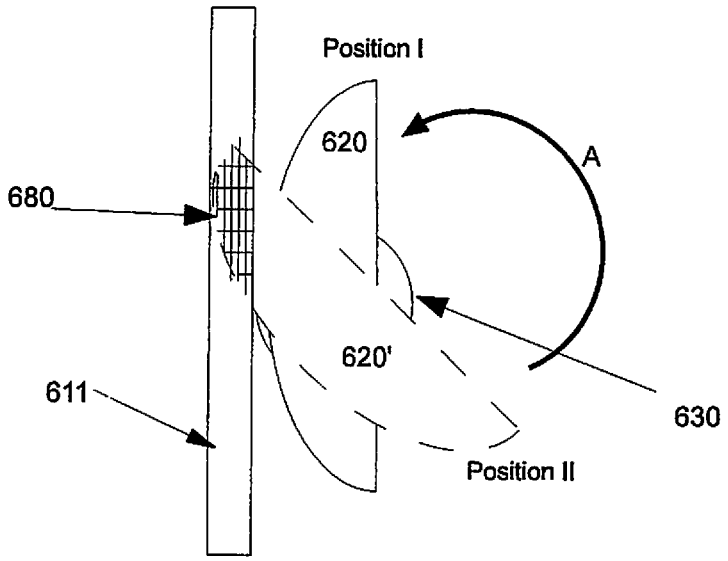
FIG. 6 shows in a detailed view a principal exemplary embodiment of an overlapping of an adaption element and an antenna element of an antenna according to the present invention.

FIG. 6 shows in a detailed view a principal exemplary embodiment of an overlapping of an adaption element 620, 620' and an antenna element 611 of an antenna according to the present invention.

In a first position I of the adaption element 620 there is no overlapping of the body of the adaption element 620 and the body of the antenna element 611. In the first position I the antenna element 611 is operable with a frequency according to the tuning effect of this first position I.

In a second position II of the adaption element 620, in FIG. 6 than referred to as 620', an extent of overlapping of the body of the adaption element 620' and the body of the antenna element 611, in FIG. 6 marked and referred to as an overlapping area 680, is given. In the second position II the antenna element 611 is operable with a frequency according to the tuning effect of this second position II.

The arrow "A" in FIG. 6 shows the direction of the rotation or moving of the adaption element 620 from the first position I to the second position II.

Figure 7:
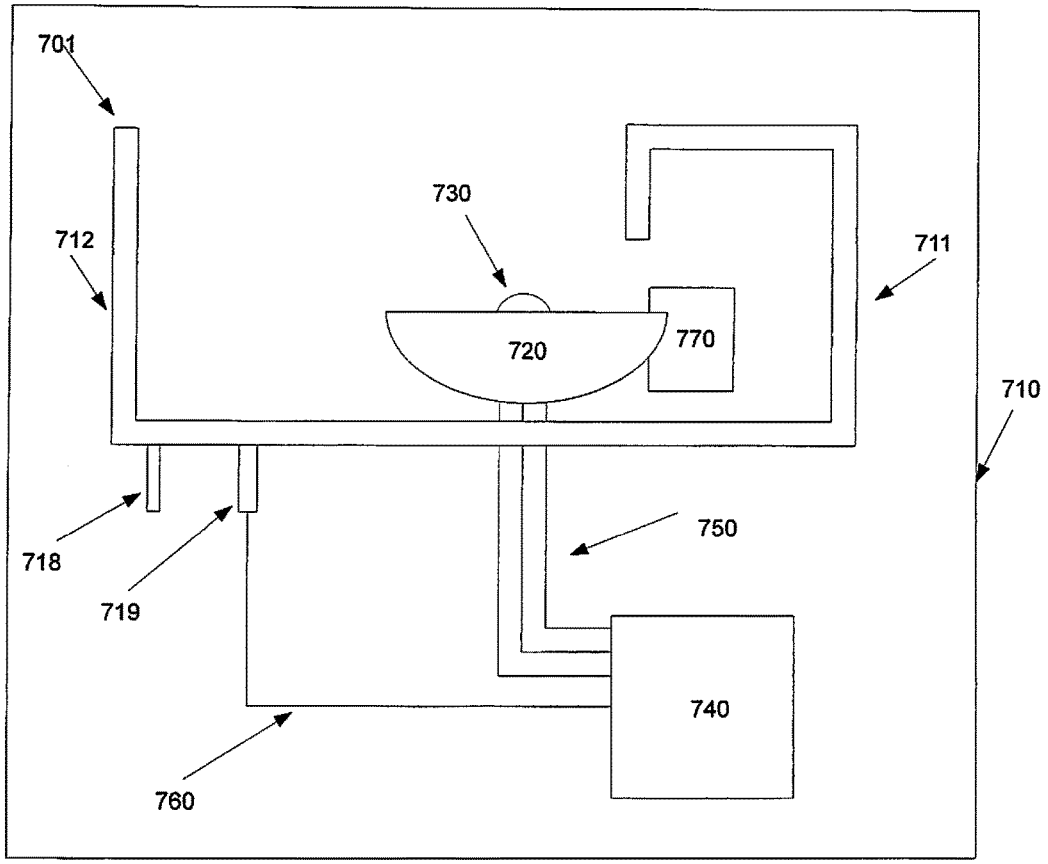
FIG. 7 shows a principal exemplary embodiment of a further antenna according to the present invention.

FIG. 7 shows a principal exemplary embodiment of a further antenna 701 according to the present invention.

The functions of the elements and/or parts of the antenna 701 according to FIG. 7 are similar or correspond to the antenna 1 according to FIG. 1.

The antenna 701 according to FIG. 7 differs from the antenna according to FIG. 1 in that the adaption element 720 has a magnetic susceptible material preferably a low-loss ferrite such as an Yttrium Iron Garnet film (YIG-film). The antenna 701 further comprises a magnet 770, preferably a permanent magnet. The magnet is stationary located close to the antenna 701 or close to at least one of the antenna elements 711, 712.

The adaption element 720 and the magnet, 770 are movable relative to each other, preferably the adaption element 720, in FIG. 7 is movable relative to the magnet 770.

The magnet 770 is advantageously a permanent magnet preferably formed in one piece of magnetic material such as an alloy of iron, cobalt, nickel or ferrites. The magnet 770 applies a magnetic field, preferably a static magnetic field which is advantageously usable in combination with the magnetic susceptible material of the adaption element 720. By moving the magnetic susceptible material 720 in the applied magnetic field from the magnet 770 the magnetic permeability constant $\mu_r$ is changeable in such a way that advantageously the antenna characteristics of the antenna 701 or influenced especially the resonant frequency or transmitted power.

Alternatively or optionally it is possible to arrange the magnetic susceptible material (720) in a stationary manner close to the antenna 701 and to arrange the magnet 770 moveable to the magnetic susceptible material 720.

Figure 8:
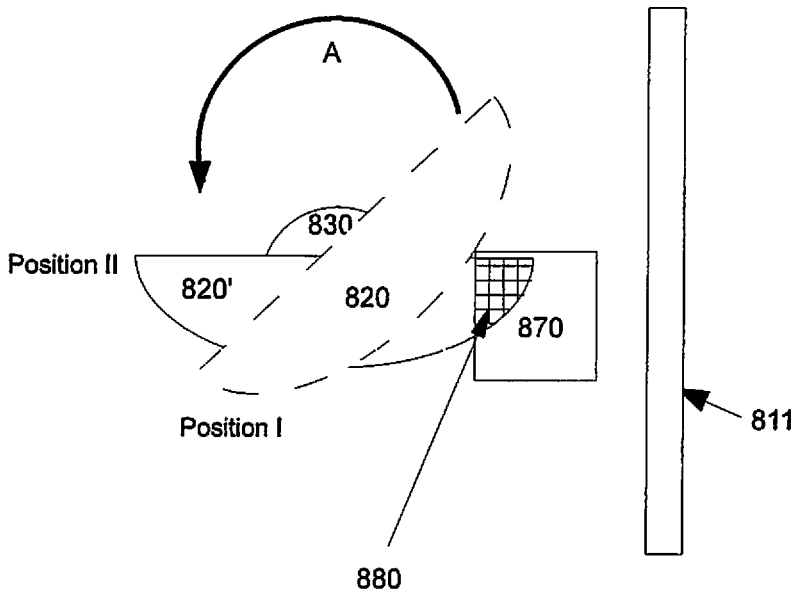
FIG. 8 shows in a detailed view a principal exemplary embodiment of an overlapping of an adaption element and a magnet of an antenna according to the present invention.

FIG. 8 shows in a detailed view a principal exemplary embodiment of an overlapping of an adaption element and a magnet of an antenna according to the present invention.

When moving the magnetic susceptible material or adaption element 820 relative to the magnet 870 into a first position I as depicted in FIG. 8 there is no overlapping of the body of the adaption element 820 and the body of the magnet 870. In this position the antenna element 811 is advantageously operable with a frequency according to tuning effect of this first position I.

In a second position II of the adaption element 820, in FIG. 8 than referred to as 820', an extent of overlapping of the body of the adaption element 820' and the body of the magnet 870, in FIG. 8 marked and referred to as an overlapping area 880, is given. In the second position II the antenna element 811 is operable with a frequency according to the tuning effect of this second position.

The arrow "A" in FIG. 8 shows a direction of the rotation or moving of the adaption element 820 from the first position I to the second position II.

The exemplary embodiments of the invention shown in the figures of the drawing and explained in connection with the description merely serve to explain the invention and are in no way restrictive.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single processor or other unit may fulfill the functions of several items recited in the claims. Any reference signs in the claims should not be construed as limiting the scope.

LIST OF REFERENCES 1 antenna
10 circuit board

11 antenna element
12 second antenna element
18 ground point
19 antenna feed point
20 adaption element
30 motor/electric motor/vibra/actuator
40 control means/chip set
50 connections between actuator and control means
60 connection between antenna feed point and control means
201 antenna
210 circuit board
211 antenna element
212 second antenna element
218 ground point
219 feed point
220 adaption element
221 second adaption element
230 motor/electric motor/vibra/actuator
231 second motor/second electric motor/second vibra/second actuator
240 control means/chip set
250 connections between actuator and control means
251 connections between second actuator and control means
260 connection between antenna feed point and control means
301 antenna
310 circuit board
311 antenna element
312 second antenna element
318 ground point
319 feed point
320 adaption element
330 motor/electric motor/vibra/actuator
340 control means/chip set
350 connections between actuator and control means
360 connection between antenna feed point and control means
370 tuneable matching circuit (TMC)
401 antenna
410 circuit board
411 antenna element
412 second antenna element
418 ground point
419 feed point
420 adaption element
430 motor/electric motor/vibra/actuator
440 control means/chip set
450 connections between actuator and control means
460 connection between antenna feed point and control means
470 magnet
480 overlapping area of adaption element and magnet
520 adaption element
530 motor/electric motor/vibra/actuator
611 antenna element
620 adaption element in position I
620' adaption element in position II
630 motor/electric motor/vibra/actuator
680 overlapping area of adaption element and antenna element
701 antenna
710 circuit board
711 antenna element
712 second antenna element
718 ground point
719 feed point
720 adaption element
730 motor/electric motor/vibra/actuator
740 control means/chip set
750 connections between actuator and control means
760 connection between antenna feed point and control means
770 magnet
811 antenna element
820 adaption element in position I
820' adaption element in position II
830 motor/electric motor/vibra/actuator
870 magnet
880 overlapping area of adaption element and magnet
A rotation/movement from position I to position II

What is claims is:

1. A tuneable antenna for a wireless communication device, comprising:

at least one antenna element;

at least one adaption element, wherein the adaption element has an electric and/or magnetic susceptible material and is movable relative to the antenna element, wherein the position of the adaption element relative to the antenna element is adjustable by at least one actuator as a function of at least one antenna characteristic associated with the at least one antenna element;

control means for controlling the at least one actuator for adjusting the position of the adaption element relative to the antenna element and/or for determining the at least one of the antenna characteristic; and at least one tuneable matching circuit for adjusting the impedance of the antenna, and wherein the tuneable matching circuit interacts with the control means for adjusting the impedance of the antenna and the control means are adapted for adjusting the position of the adaption element relative to the antenna element as a function of the at least one antenna characteristic.

2. The antenna according to claim 1, wherein the at least one antenna characteristic is the radiation pattern of the antenna.

3. The antenna according to claim 1, wherein the at least one antenna characteristic is at least one resonant frequency of the antenna.

4. The antenna according to claim 1, wherein the function of the antenna characteristic is dependent on the conditions of transmitted and/or received antenna power of the antenna.

5. The antenna according to claim 1, wherein the at least one antenna characteristic is electrically and/or magnetically influenceable from the extent of overlapping of the body of the adaption element and the body of the antenna element.

6. The antenna according to claim 1, wherein the antenna further comprises a magnet, wherein the magnet and the adaption element are moveable relative to each other.

7. The antenna according to claim 1, wherein the adaption element and/or the electric susceptible material of the adaption element is shaped to adjust the at least one antenna characteristic.

8. The antenna according to claim 1, wherein the electric susceptible material of the adaption element has a very high relative permittivity or dielectric constant.

9. The antenna according to claim 8, wherein the electric susceptible material is one of Aluminum oxide, Titanium oxide, Strontium Titanate, low-loss ferrites or a combination thereof.

10. The antenna according to 1, wherein the magnetic susceptible material of the adaption element has a high relative permeability or magnet constant.

11. The antenna according to 10, wherein the magnetic susceptible material is a low-loss ferrite.

12. The antenna according to claim 1, wherein the adaption element and/or the magnetic susceptible material of the adaption element is magnetically influenceable from the extent of overlapping of the body of the adaption element and the body of the magnet.

13. The antenna according to claim 1, wherein the adaption element is rotatable and/or pivotable relative to the antenna element.

14. The antenna according to claim 1, wherein the adaption element is mounted on the actuator.

15. The antenna according to claim 1, wherein the actuator is an electric motor.

16. The antenna according to claim 15, wherein the actuator is a motor causing vibrational movement.

17. The antenna according to claim 1, wherein the antenna comprises:

a first antenna element operable in a first frequency band; and a second antenna element operable in a second frequency band, wherein the resonant frequency of the first frequency band is separately adjustable from the resonant frequency at the second frequency band by at least one actuator.

18. A tuneable antenna for a wireless communication device, comprising:

at least one antenna element;

at least one adaption element, wherein the adaption element has an electric and/or magnetic susceptible material and is movable relative to the antenna element, wherein the position of the adaption element relative to the antenna element is adjustable by at least one actuator as a function of at least one antenna characteristic associated with the at least one antenna element;

a controller for controlling the at least one actuator for adjusting the position of the adaption element relative to the antenna element and/or for determining the at least one antenna characteristic; and at least one tuneable matching circuit for adjusting the impedance of the antenna, and wherein the tuneable matching circuit interacts with the controller for adjusting the impedance of the antenna and the controller are adapted for adjusting the position of the adaption element relative to the antenna element as a function of the at least one antenna characteristic.

19. The antenna according to claim 18, wherein the controller is implemented as an open-loop controller or a closed-loop controller.

20. The antenna according to claim 18, wherein the at least one antenna characteristic is at least one resonant frequency of the antenna.

* * * * *